US006328904B1

(12) United States Patent
Hattori et al.

(10) Patent No.: US 6,328,904 B1
(45) Date of Patent: Dec. 11, 2001

(54) MANUFACTURE OF A FIELD EMISSION ELEMENT WITH FINED EMITTER ELECTRODE

(75) Inventors: Atsuo Hattori; Chiharu Iriguchi, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/460,358

(22) Filed: Dec. 13, 1999

(30) Foreign Application Priority Data

Dec. 14, 1998 (JP) ..... 10-354850

(51) Int. Cl.[7] ..... B44C 1/22; H01J 9/00

(52) U.S. Cl. ..... 216/11; 445/51; 445/24; 438/20

(58) Field of Search ..... 216/41, 13, 11; 438/20; 445/24, 50, 51

(56) References Cited

U.S. PATENT DOCUMENTS 5,795,208 * 8/1998 Hattori ..... 445/50

FOREIGN PATENT DOCUMENTS 9-17335 1/1997 (JP) .
9-274846 10/1997 (JP) .

* cited by examiner

*Primary Examiner*—Gregory Mills
*Assistant Examiner*—P. Hassanzadeh
(74) *Attorney, Agent, or Firm*—Ostrolenk, Faber, Gerb & Soffen, LLP

(57) ABSTRACT

A method of manufacturing a field emission element comprises steps of: (a) forming a base layer comprising a gate film being capable of chemical reaction accompanied by volume expansion; (b) forming an insulating film on said base layer; (c) forming a taper-shaped first hole in said insulating film; (d) forming a second hole in said gate film by anisotropically etching said gate film using said insulating film as a mask; (e) reacting a part of a surface layer of said gate film to form a volume-expanded film by chemical reaction; (f) forming an emitter film made of an electrically conductive material on said insulating film and said expanded film; and (g) exposing said emitter film and said gate film by removing unnecessary parts comprising said substrate and said expanded film.

11 Claims, 11 Drawing Sheets

MANUFACTURE OF A FIELD EMISSION ELEMENT WITH FINED EMITTER ELECTRODE

This application is based on Japanese Patent Application HEI 10-354850, filed on Dec. 14, 1998, the entire contents of which are incorporated herein by reference.

BACKGROUND OF THE INVENTION a) Field of the Invention

The present invention relates to a manufacture method of a field emission element, and more particularly to a method of manufacturing a field emission element emitting electrons from a sharp tip of an emitter.

b) Description of the Related Art

A field emission element emits electrons from a sharp tip of an emitter by utilizing electric field concentration. For example, a flat panel display can be structured by using a field emitter array (FEA) having a number of emitters disposed in array. Each emitter controls the luminance of a corresponding pixel of the display.

In a field emission element, a gate electrode is configured near an emitter electrode. By applying positive potential to the gate electrode, the emitter electrode can emit electrons to an anode electrode.

Providing that an emitting current is same or increases, the field emission element is desired to have such properties as a decreased threshold voltage between the gate electrode and emitting electrode, fast drive and reduced power consumption. Consideration in choosing a structure and shape of the element is required to obtain those properties. In addition, for a steady and easy manufacture of such element, special consideration is necessary for the manufacturing process.

The shape of the emitter electrode especially influences on the above-listed properties. Most importantly, the emitter electrode should have a fine tip. By making an apex angle of the emitter electrode as small as possible, electric field at the tip will be strong enough to reduce the threshold voltage between the gate electrode and emitting electrode. Therefore, provided that the emitting current obtained is the same, it is possible to reduce the threshold voltage. Provided that the threshold voltage is the same, it is possible to obtain a larger emitting current by the same threshold voltage between the gate electrode and emitting electrode than using the emitter electrode with a larger apex angled tip. Therefore, it is important to utilize a manufacturing method that easily enables sharpening the tip of the emitting electrode.

Especially, as shown in FIGS. 10A and 10B, a composite-shaped emitter electrode, which has an outline composed of two parts of lines (straight lines as shown in FIG. 10A or curves as shown in FIG. 10B), has a fine tip and good electrical properties. At meantime, the emitter electrode has a wide base, and so the casting of material for electrode to an emitter mold can be easily performed.

Some manufacturing methods of the composite-shaped emitter electrode have been provided conventionally.

For example, the assignee of this application discloses a manufacturing method of the emitter electrode in JP-A HEI 09-274846. The method includes steps of forming an overhung gate electrode, depositing a sacrificial film to an overhanging portion of the gate electrode by a deposition method having good step coverage, performing a wet oxidation process to the sacrificial film for volume expansion after diffusing impurities to a portion corresponding the tip of the emitter electrode. In the same processing time, a region with diffused impurities expands more likely than a region without diffused impurities. Therefore, the wet oxidation process of the sacrificial film will form an emitter electrode mold that has the composite-shaped cross-section including two different degrees of volume expansion.

Moreover, JP-A HEI 09-17335 discloses another manufacturing method of the composite-shaped emitter electrode. In the method, an emitter electrode is formed by following steps. At first, on a substrate having concaves is formed a gate oxide film having smaller openings than the concaves on the substrate. Then, an electrode material is deposited on the gate oxide film by sputtering to form gate electrodes on the gate oxide film and emitter electrodes on the concaves under the openings of the gate oxide film.

In the prior art, it is difficult to control over the oxidation process and film thickness of the gate film. Moreover, it is impossible to make an insulating film thick, and therefore, a distance between emitter gates will be too short causing low insulation-resistant, and fast drive is limited due to high capacitance.

SUMMARY OF THE INVENTION

It is an object of the present invention to provide a field emission element having an emitter electrode with a fine tip and method of manufacturing the field emission element.

According to one aspect of the present invention, there is provided a method of manufacturing a field emission element comprising the steps of forming, on a substrate, a base layer comprising a gate film formed of a conductive material which is capable of chemical reaction accompanying volume expansion, forming an insulating film on said base layer, forming a taper-shaped first hole in said insulating film, forming a second hole in said gate film by anisotropically etching said gate film using said insulating film as a mask, reacting a part of a surface layer of said gate film to form a volume-expanded film by chemical reaction, forming an emitter film made of an electrically conductive material on said insulating film and said expanded film, and exposing said emitter film and said gate film by removing unnecessary parts comprising said substrate and said expanded film.

Volume expansion of the gate film by the chemical reaction makes it possible to obtain the chemically reacted film that expands toward the center of the opening. A mold of an emitter electrode with a fine tip can be obtained by using the chemically reacted film. In addition, a step of diffusing impurities will not be required.

According to another aspect of the present invention, there is provided a field emission element comprising a gate electrode having a gate hole, and overhanging toward a center of the gate hole, an emitter electrode whose tip is extending near said gate hole, and an insulating film formed between said gate electrode and said emitter electrode.

Because the mold of the emitter electrode is formed by the volume expansion caused by the chemical reaction of the gate film on both or either of up and down side of which the insulating film or a reaction inhibitive film is deposited, a gorge formed by the expansion can be used as the mold of the fine tip of the emitter electrode.

Further, forming the emitter electrode into the composite-shape makes it easy to fill the material into the mold. A beak-shaped tip of the gate electrode formed by the chemical reaction prevents concentration of stress at the gate, and therefore, it can prevent generation of a short circuit or leak between the emitter and the gate.

DETAILED DESCRIPTION OF THE PREFERRED EMBODIMENTS

A manufacturing method of field emission elements according to embodiments of this invention will be described with reference to drawings. The first embodiment is a manufacturing method of a two-electrode element having an emitter (a field emission cathode) and a gate. The two-electrode element has an emitter electrode that emits electrons and has a gate electrode that controls a field.

FIGS. 1A to 1G show a manufacturing process of the field emission element according to the first embodiment. In the process shown in FIGS. 1A to 1D, a gate electrode having a gate hole is formed on a substrate. In the process shown in FIGS. 1E to 1G, the gate electrode is expanded by chemical reaction to form a mold for a composite-shaped emitter electrode, and then to form an emitter electrode by using the mold.

Figure 1A:
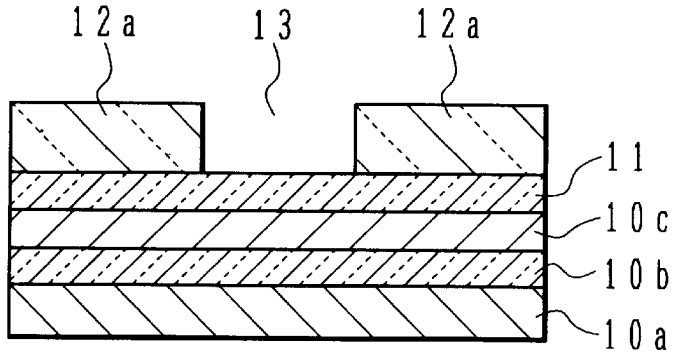
FIGS. 1A to 1G show a manufacturing process of a field emission element according to the first embodiment.

At first, as shown in FIG. 1A, a first reaction inhibitive film (oxidation inhibitive film) 10*b* made of $SiN_x$ is formed to have a thickness of about 1000 angstroms, for example, on a silicon (Si) substrate 10*a*. The first reaction inhibitive film 10*b* is, for example, formed by the low pressure (LP) chemical vapor deposition (CVD) method using $SiH_2Cl_2$+ $NH_3$ gas as source gas. Inside pressure of a reaction chamber is held at 60 Pa, and a temperature of the substrate is at 760 degrees centigrade.

Next, a gate electrode film 10*c* made of poly-crystalline silicon having a thickness of about 1500 angstroms is formed on the first reaction inhibitive film 10*b*. The gate electrode film 10*c* is, for example, formed by the low pressure CVD method using $SiH_4$ gas as source gas. The inside pressure of the reaction chamber is held at 30 Pa, and the temperature of the substrate is at 625 degrees centigrade.

Next, a second reaction inhibitive film (oxidation inhibitive film) 11 made of $SiN_x$ is formed to have a thickness of about 1000 angstroms on the gate electrode film 10*c,* and thereon is formed a first sacrificial film (an insulating film) 12*a* made of $SiO_2$, phosphosilicate glass (PSG) or borophosphosilicate glass (BPSG) and having a thickness of about 2000 angstroms. These films 11 and 12*a* are formed, for example, by the normal-pressure (atmosphere pressure) CVD method using $O_3$ and tetra-ethyl-ortho silicate (TEOS) as source gas at the substrate temperature of 400 degrees centigrade.

Next, resist material is applied to the surface of the first sacrificial film 12*a* to form a resist pattern having a cylindrical opening with a diameter of 0.6 micrometers by photolithography. Then, as shown in FIG. 1A, a concave (i.e. a hole) 13 having a vertical or almost vertical sidewall reaching the second reaction inhibitive film 11 is formed by anisotropically etching the first sacrificial film 12*a*. In this manner, the first sacrificial film 12*a* having the concave 13 is formed. This etching is performed by using, for example, a magnetron enhanced reactive ion etching (RIE) system and $CHF_3$+$CO_2$+Ar as etching gas at an inside pressure of 50 mTorr.

Figure 1B:
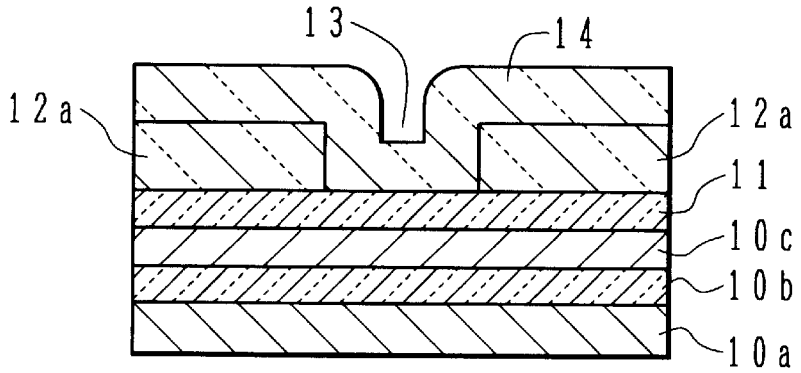

Next, as shown in FIG. 1B, a second sacrificial film 14 made of silicon oxide film, PSG or BPSG is deposited isotropically all over the surface of the substrate at a thickness of about 2500 angstroms. The second sacrificial film 14 is formed, for example, by the normal-pressured CVD method using $O_3$ and TEOS as source gas at the substrate temperature of 400 degrees centigrade.

Figure 1C:
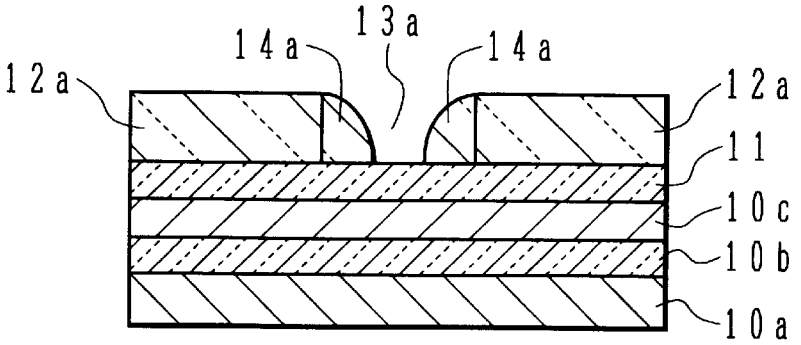

Then, as shown in FIG. 1C, the second sacrificial film 14 is etched back anisotropically by about 2500 angstroms to form a side spacer 14*a* remaining only on the sidewall of the concave 13. The side spacer 14*a* has a concave 13*a* shaped like a taper of which a diameter becomes gradually increased toward the upper part. This etching is performed by using, for example, the magnetron enhanced RIE system and $CHF_3$+$CO_2$+Ar as etching gas at an inside pressure of 50 mTorr.

Figure 1D:
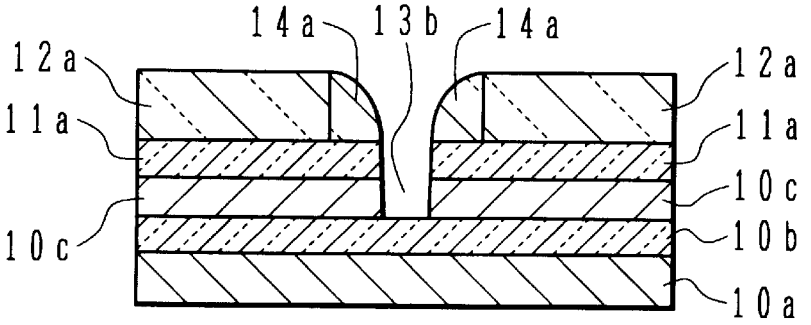

Next, as shown in FIG. 1D, a concave 13*b* (a gate hole) reaching the surface of the first reaction inhibitive film 10*b* is formed by anisotropically etching the second reaction inhibitive film 11 and the gate electrode film 10*c* using the side spacer 14*a* and the first sacrificial film 12*a* as a mask. The concave 13*b* is shaped like cylindrical and has a circular plan shape. The cross section of the gate electrode film 10*c* in FIG. 1D is divided into two parts with the concave 13*b* between there.

Figure 1E:
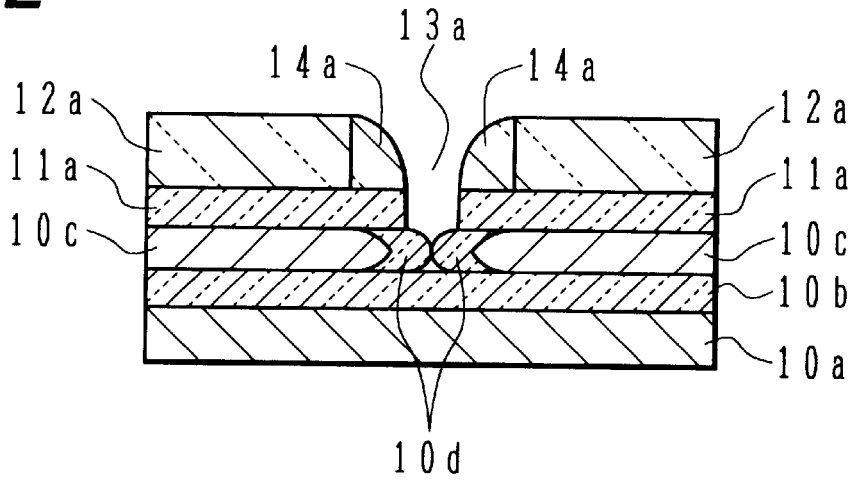

Next, an oxidation process is performed by the wet oxidation method. The oxidation process, wherein hydrogen flow is set at 19 slm and oxygen flow is set at 19 slm to form water vapor and excess oxygen gas, is performed for about 20 minutes at 1000 degrees centigrade. As shown in FIG. 1E, the exposed surface of the gate electrode 10*c,* which is made of poly-crystalline silicon, is oxidized in the oxidation process to form a volume-expanded oxide layer 10*d*.

The reaction inhibitive films 10*b* and 11*a* made of $SiN_x$ are almost not oxidized. As the oxidation progresses, the oxide layer 10*d* having two parts in cross section gradually expands toward the center of the concave 13*b* until one part of the oxide layer 10*d* contacts the other part. Although the oxidation should be terminated immediately after the contact, it may be terminated before the contact. The expanded oxide layer 10*d,* the second reaction inhibitive film 11*a* and the first sacrificial film 12*a* will form a mold for the composite-shaped emitter electrode.

Figure 1F:
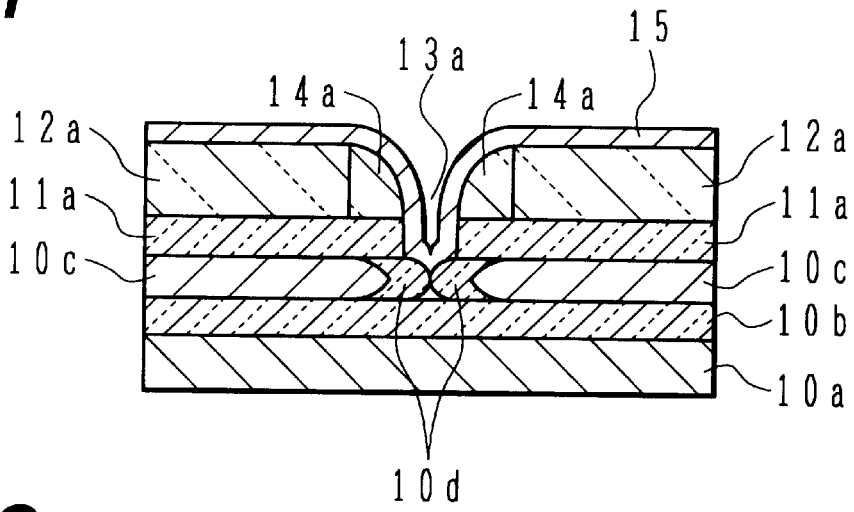

Next, as shown in FIG. 1F, an emitter electrode film 15 made of $TiN_x$ for example is deposited at a thickness of 0.2 micrometers by reactive-sputtering on the oxide layer 10*d,* the second reaction inhibitive film 11*a,* the side spacer 14*a* and the first sacrificial film 12*a*. The sputtering is performed by using a DC sputtering system at a power of 5 kw, a pressure of 4 mTorr and using Ti as a target while $N_2$ gas as a reaction gas and Ar gas is supplied. Further, Mo, Cr, Ti or W, instead of $TiN_x$, can be used for making the emitter electrode film 15. Also, the CVD method or evaporation method can be used instead of the sputtering.

Figure 1G:
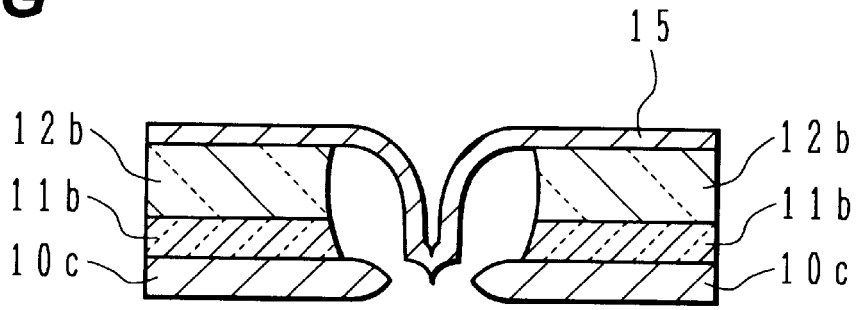

At last, as shown in FIG. 1G, all of the substrate 10*a,* the first reaction inhibitive film 10*b,* the oxide layer 10*d* and the side spacer 14*a* and parts of the second reaction inhibitive film 11*a* and the first sacrificial film 12*a* are removed to expose the gate electrode 10*c* and the emitter electrode 15. In this manner, a two-electrode element can be obtained. $HF+HNO_3+CH_3COOH$ is used for the etching of the silicon substrate 10*a*. $HF+NH_4F$ is used for the etching of the first sacrificial film 12*a* and the side spacer 14*a* both made of silicon oxide. $H_3PO_4$ heated at a temperature of 160 degrees centigrade is used for the etching of the first and second reaction inhibitive films 10*b* and 11*a* both made of $SiN_x$.

The emitter electrode 15 obtained in this manner has a fine tip that can improve electrical properties, and at the same time, a material of the emitter electrode can be easily filled into the mold for the emitter electrode because the base part (an upper side of the drawing) of the emitter electrode 15 is widened. Further, methods disclosed in the description of embodiments in the previously mentioned, which is incorporated therein by reference, JP-A HEI 09-274846 can be used for the formation process of the emitter electrode after the process shown in FIG. 1E.

The tip of the emitter electrode 15 can be fined by ion milling from the down side after the emitter electrode 15 is exposed. The emitter electrode 15 may also be made of electrically conductive material such as dispersive ultra fine particles.

Figure 2A:
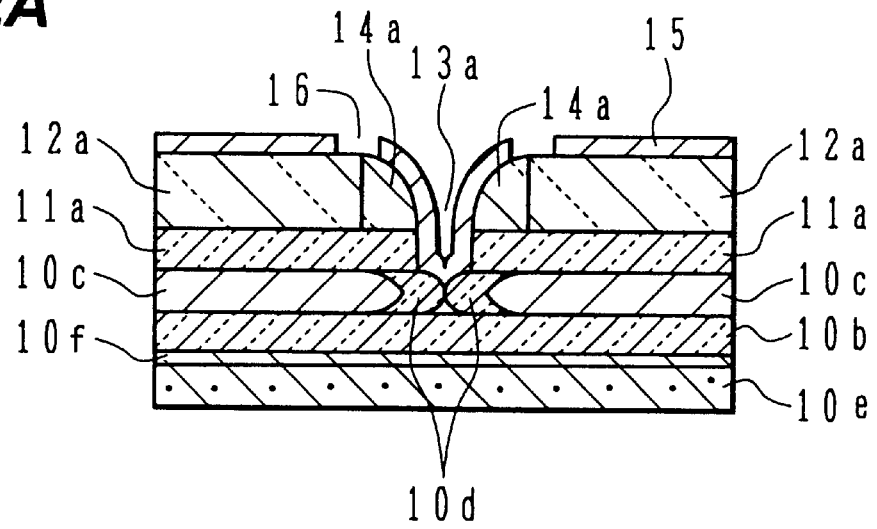
FIGS. 2A and 2B show a manufacturing process of a field emission element having a three-electrode element.
Figure 2B:
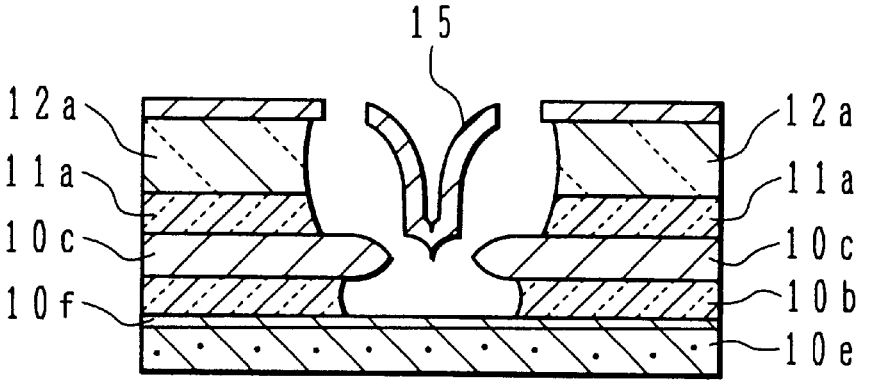

FIGS. 2A and 2B show a manufacturing process of a field emission element having a three-electrode element. Similar processes used for the first embodiment can manufacture the three-electrode element. In the manufacture of the three-electrode element, instead of the step shown in FIG. 1G, the steps shown in FIG. 2A and 2B are performed.

At first, similar to the process shown in FIGS. 1A to 1D, a gate electrode having a gate hole is formed on a substrate. In this case, a transparent electrode (an anode electrode) 10*f* made of ITO or the like is formed on a transparent substrate 10*e,* e.g., a glass substrate, instead of the silicon (Si) substrate 10*a*. Then, similar to the process shown in FIGS. 1E and 1F, the gate electrode is expanded by chemical reaction (oxidation) to form a mold for a composite-shaped emitter electrode, and then to form an emitter electrode by using the mold.

Next, a resist film (not shown) having a predetermined pattern is formed on the emitter electrode 15. By using this resist pattern as a mask, as shown in FIG. 2A, slit openings 16 are formed on both sides of an emitter electrode 15 by, for example, RIE using $Cl_2$ containing etchant.

Next, through the slit openings 16, all of the oxide layer 10*d* and the side spacer 14*a* and parts of the first reaction inhibitive film 10*b,* the second reaction inhibitive film 11*a* and the first sacrificial film 12*a* are removed to expose the gate electrode 10*c* and the emitter electrode 15 as shown in FIG. 2B.

Figure 3A:
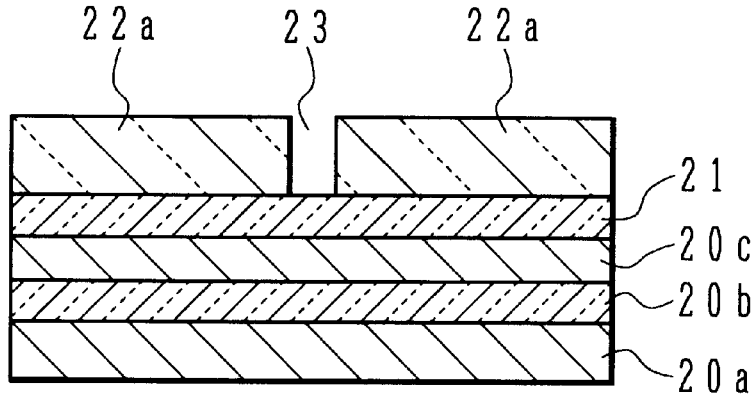
FIGS. 3A to 3C show a manufacturing process of a field emission element according to a second embodiment.
Figure 3B:
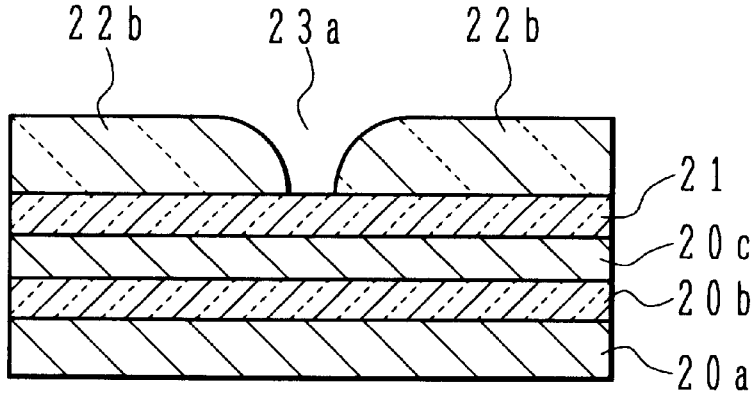
Figure 3C:
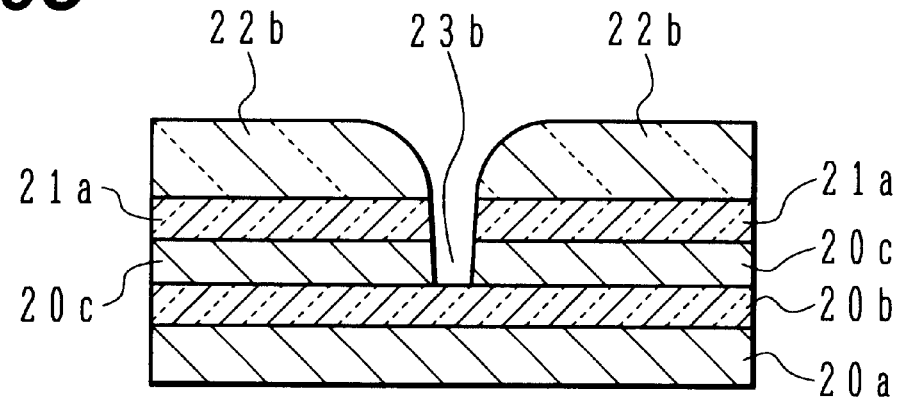

FIGS. 3A to 3C show a manufacturing process of a field emission element according to a second embodiment. In the process shown in FIGS. 3A to 3C, a gate electrode having a gate hole is formed on a substrate. Then, similar to the process shown in FIGS. 1E to 1G, the gate electrode is expanded by chemical reaction (oxidation) to form a mold for a composite-shaped emitter electrode, and then to form an emitter electrode by using the mold.

At first, as shown in FIG. 3A, a first reaction inhibitive film (oxidation control film) 20*b* made of $SiN_x$ is formed to have a thickness of about 1000 angstroms on, for example, a silicon (Si) substrate 20*a*. The first reaction inhibitive film 20*b* is, for example, formed by the low pressure CVD method using $SiH_2Cl_2+NH_3$ gas as source gas. Inside pressure of a reaction chamber is held at 60 Pa, and a temperature of the substrate is at 760 degrees centigrade.

Next, a gate electrode film 20*c* made of poly-crystalline silicon having a thickness of about 1500 angstroms is formed on the first reaction inhibitive film 20*b*. The gate electrode film 20*c* is, for example, formed by the low pressure CVD method using $SiH_4$ gas as source gas. The inside pressure of the reaction chamber is held at 30 Pa, and the temperature of the substrate is at 625 degrees centigrade.

Next, a second reaction inhibitive film (oxidation control film) 21 made of $SiN_x$ is formed to have a thickness of about 1000 angstroms on the gate electrode film 20*c,* and thereon is formed a first sacrificial film (an insulating film) 22 made of PSG or BPSG and having a thickness of about 2000 angstroms. When low-melting-point glass of BPSG film is formed, the first sacrificial film 22 may be formed by the CVD method wherein 9.1 mol % of $B_2O_3$ and 5.3 mol % of $P_3O_5$ are added to the source gas.

Next, resist material is applied to the surface of the first sacrificial film 22 to form a resist pattern having a cylindrical opening with a diameter of 0.6 micrometers by photolithography. Then, as shown in FIG. 3A, a concave 23 (a hole) having a vertical or almost vertical sidewall reaching the second reaction inhibitive film 21 is formed by anisotropically etching the first sacrificial film 22. In this manner, the first sacrificial film 22*a* having the concave 23 is formed. This etching is performed by using, for example, the magnetron enhanced RIE system and $CHF_3+CO_2+Ar$ as etching gas at an inside pressure of 50 mTorr.

Next, as shown in FIG. 3B, the first sacrificial film 22*a* is heated to reflow for forming a concave 23*a* having the taper-shape of which a diameter gradually increases toward the upper part. In this manner, the first sacrificial film 22*b* having the taper-shaped concave 23*a* is obtained. When low-melting-point glass is PSG or BPSG, it may be reflowed by using a heating furnace at a temperature of 750 to 950 degrees centigrade for 10 to 20 minutes.

Lamp annealing or laser annealing makes it possible to reflow the low-melting-point glass in a short time such as 10 to 100 seconds. For example, a BPSG film is lamp annealed in $N_2$ atmosphere, while being heated from room temperature to 850 to 1050 degrees centigrade and kept for 10 to 60 seconds.

Next, as shown in FIG. 3C, a concave 23*b* (a gate hole) reaching the surface of the first reaction inhibitive film 20*b* is formed by anisotropically etching the second reaction inhibitive film 21 and the gate electrode film 20*c* using the first sacrificial film 22*b* as a mask. This etching is performed by using, for example, the magnetron enhanced RIE system and $CHF_3+CO_2+Ar$ as etching gas at an inside pressure of 50 mTorr. Further, gas flow of $CO_2$ is at 32 sccm, $CHF_3$ is at 8 sccm and Ar is at 30 sccm.

Next, as afore-described along with FIGS. 1E to 1G, the gate electrode 20*c* is oxidized. An emitter electrode is formed by casting with a reaction film expanded by the oxidation and the other films as a mold. The oxidation process is performed at a temperature of 1000 degrees centigrade for about 20 minutes in oxidizing atmosphere formed by hydrogen flowing at 19 slm and oxygen flowing at 19 slm.

Figure 4A:
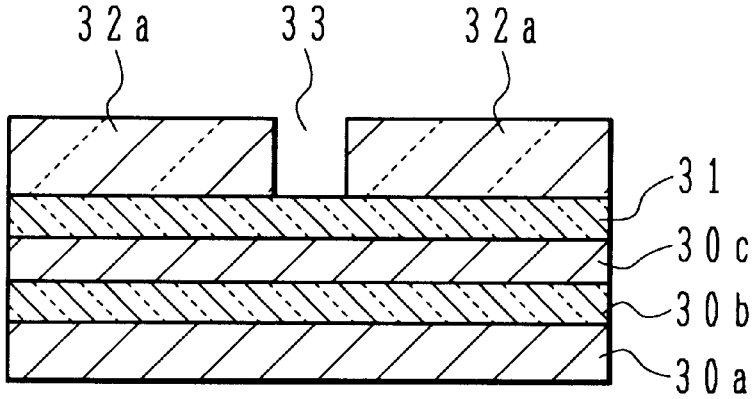
FIGS. 4A to 4C show a manufacturing process of a field emission element according to a third embodiment.
Figure 4B:
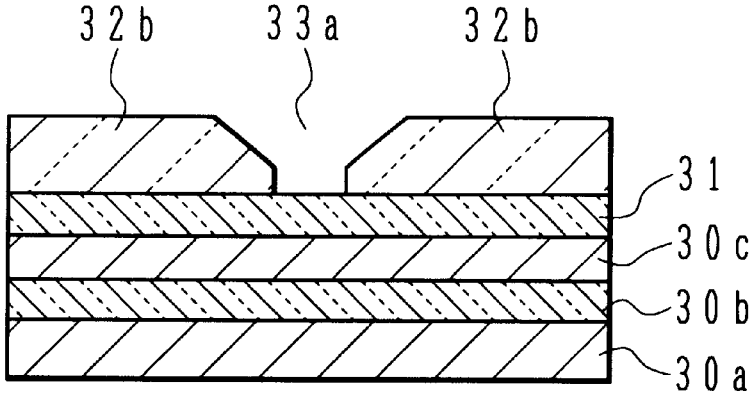
Figure 4C:
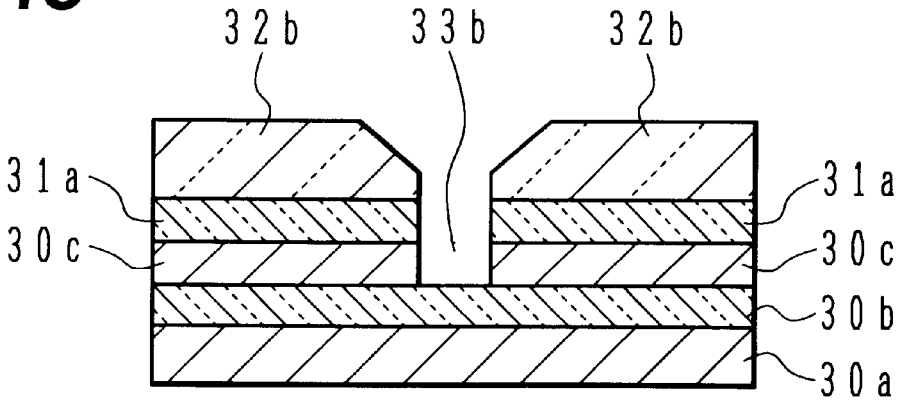

FIGS. 4A to 4C show a manufacturing process of a field emission element according to a third embodiment. In the process shown in FIGS. 4A to 4C, a gate electrode having a gate hole is formed on a substrate. Then, similar to the process shown in FIGS. 1E to 1G, the gate electrode is expanded by chemical reaction (oxidation) to form a mold for a composite-shaped emitter electrode, and then to form an emitter electrode by using the mold.

At first, as shown in FIG. 4A, a first reaction inhibitive film (oxidation control film) 30*b* made of $SiN_x$ is formed to have a thickness of about 1000 angstroms on, for example, a silicon (Si) substrate 30*a*.

Next, a gate electrode film 30*c* made of poly-crystalline silicon having a thickness of about 1500 angstroms is formed on the first reaction inhibitive film 30*b* . The gate electrode film 30*c* is, for example, formed by the low pressure CVD method using $SiH_4$ gas as source gas. The inside pressure of the reaction chamber is held at 30 Pa, and the temperature of the substrate is at 625 degrees centigrade.

Next, a second reaction inhibitive film (oxidation control film) 31 made of $SiN_x$ is formed to have a thickness of about 1000 angstroms on the gate electrode film 30*c*. The second reaction inhibitive film 31 is, for example, formed by the low pressure CVD method using $SiH_2Cl_2$+$NH_3$ gas as source gas. Inside pressure of a reaction chamber is held at 60 Pa, and a temperature of the substrate is at 760 degrees centigrade.

On the second reaction inhibitive film 31 is formed a first sacrificial film (an insulating film) 32 made of PSG or BPSG and having a thickness of about 2000 angstroms. The first sacrificial film 32 may be formed by the CVD method wherein $O_3$ and TEOS are used as source gas, and a temperature of the substrate is at 400 degrees centigrade.

Next, resist material is applied to the surface of the first sacrificial film 32 to form a resist pattern having a cylindrical opening with a diameter of 0.6 micrometers by photolithography. Then, as shown in FIG. 4A, a concave 33 (a hole) having a vertical or almost vertical sidewall reaching the second reaction inhibitive film 31 is formed by anisotropically etching the first sacrificial film 32. In this manner, the first sacrificial film 32*a* having the concave 33 is formed. This etching is performed by using, for example, the magnetron enhanced RIE system and $CHF_3$+$CO_2$+Ar as etching gas at an inside pressure of 50 mTorr.

Next, an edge of the first sacrificial film 32*a* is etched by ion milling or the like to make the concave 33*a* into the taper-shape in which a diameter gradually increases toward the upper side as shown in FIG. 4B.

Next, as shown in FIG. 4C, a concave 33*b* (a gate hole) reaching the surface of the first reaction inhibitive film 30*b* is formed by anisotropically etching the second reaction inhibitive film 31 and the gate electrode film 30*c* using the first sacrificial film 32*b* as a mask. The etching of the first reaction inhibitive film 30*b* is performed by using, for example, the magnetron enhanced RIE system and $CHF_3$+$CO_2$+Ar as etching gas at an inside pressure of 50 mTorr. The etching of the gate electrode film 30*c* is performed by using, for example, the magnetron enhanced RIE system and HBr as etching gas at an inside pressure of 100 mTorr.

Next, as afore-described along with FIGS. 1E to 1G, the gate electrode 30*c* is oxidized. An emitter electrode is formed by casting with a reaction film expanded by the oxidation and the other films as a mold. The oxidation process is performed at a temperature of 1000 degrees centigrade for about 20 minutes with hydrogen flowing at 19 slm and oxygen flowing at 19 slm.

Figure 5A:
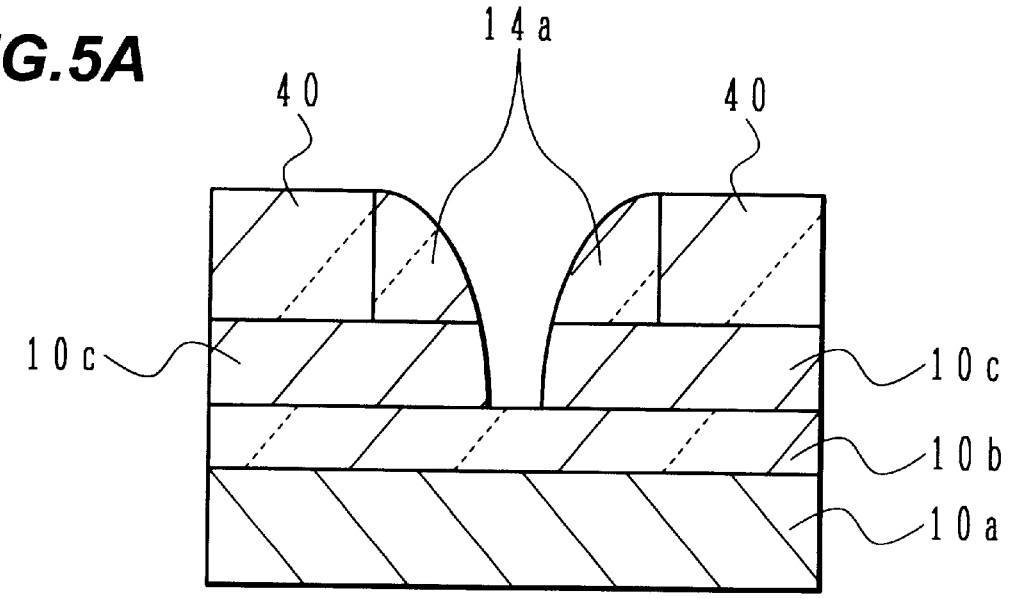
FIGS. 5A and 5B show a manufacturing process of a field emission element according to a fourth embodiment and a result of an actual simulation.
Figure 5B:
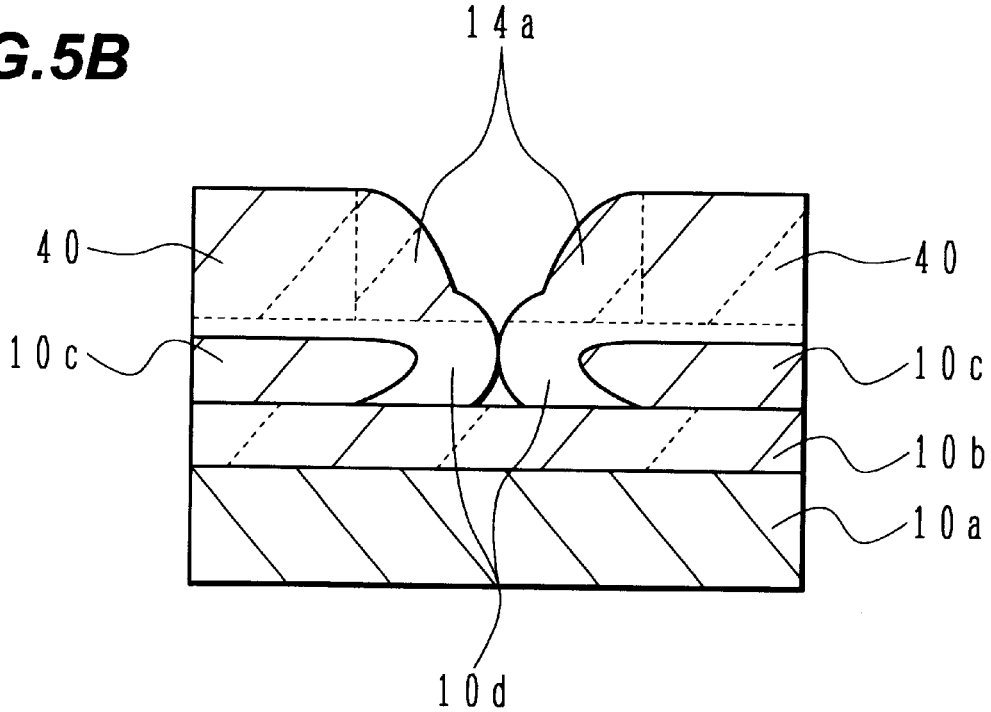

FIGS. 5A and 5B show a manufacturing process of a field emission element according to a fourth embodiment and a result of an actual simulation. The fourth embodiment shown in FIGS. 5A and 5B basically has the same process shown in FIGS. 1A to 1D. However, as shown in FIG. 5A, a first sacrificial film (an insulating film) 40 having a thickness of 2500 angstroms is directly formed on the gate electrode 10*c* instead of forming the second reaction inhibitive film 11*a* shown in FIG. 1D.

Then, similar to the process shown in FIGS. 1E to 1G, the gate electrode is expanded by chemical reaction. An emitter electrode is formed by casting with a mold that is formed by oxidizing the gate electrode 10*c* as shown in FIG. 5B. This oxidation process and the formation of the emitter electrode is basically the same as the process and the formation shown in FIGS. 1E to 1G. However, because the fourth embodiment does not have a second reaction inhibitive film, the oxidation of the upper part of the gate electrode 10*c* progresses faster (and deeper) than the lower part of it.

That is, the oxidation of the lower part of the gate electrode film 10*c* is inhibited by the first reaction inhibitive film 10*b* thereunder, and the oxidation of the upper part of the gate electrode film 10*c* is not likely inhibited because the second reaction inhibitive film is not on it. From the result of the simulation, left and right parts (in the cross section) of the oxide film 10*d* contact each other at the upper point.

Figure 6A:
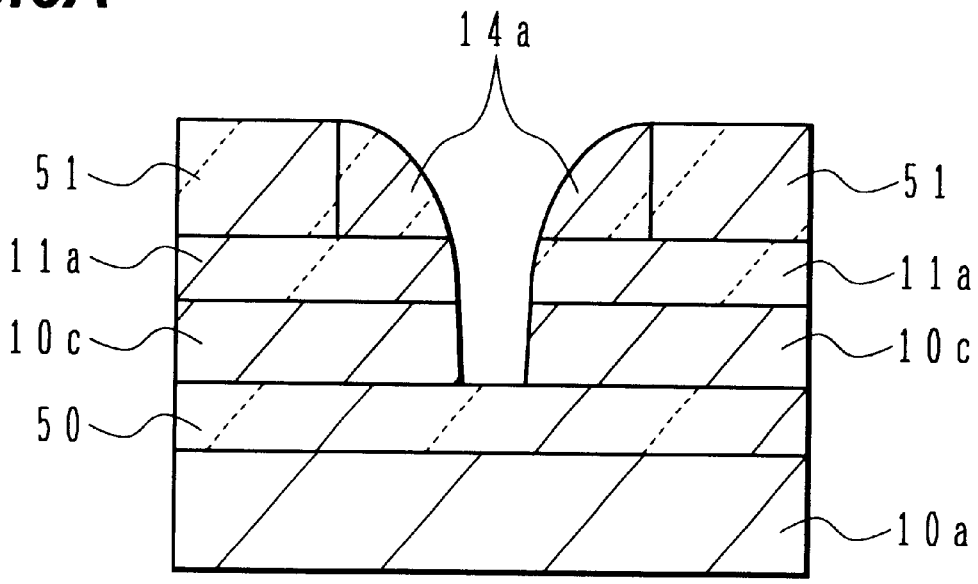
FIGS. 6A and 6B show a manufacturing process of a field emission element according to a fifth embodiment and a result of an actual simulation.
Figure 6B:
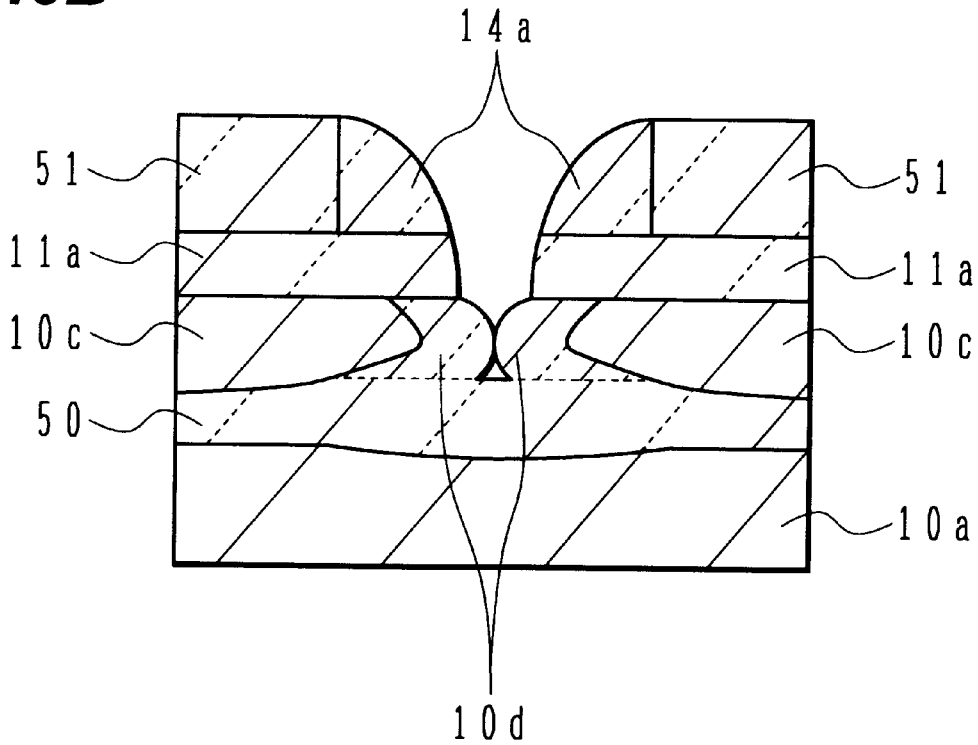

FIGS. 6A and 6B show a manufacturing process of a field emission element according to a fifth embodiment and a result of an actual simulation. The fifth embodiment shown in FIGS. 6A and 6B basically has the same process shown in FIGS. 1A to 1D. However, as shown in FIG. 6A, a sacrificial film (an insulating film) 50 that does not control chemical reaction is formed on the substrate 10*a* to have a thickness of about 1000 angstroms instead of forming the first reaction inhibitive film 10*b* shown in FIG. 1D. The sacrificial film 50 is made of, for example, $SiO_2$, PSG, BPSG or the like. Further, a first sacrificial film (an insulating film) 51 having a thickness of 2500 angstroms is formed on the second reaction inhibitive film 11*a*. The sacrificial film 51 is made of, for example, $SiO_2$, PSG, BPSG or the like.

Then, as shown in FIG. 6B, a mold for an emitter electrode is formed by chemically reacting (oxidizing) the gate electrode film 10*c*. An emitter electrode is formed by using the mold. This chemical reaction process and the formation of the emitter electrode are basically similar to the process illustrated in FIGS. 1E to 1G. However, clearly seen from the result of the simulation, the oxidation process at the lower part of the gate electrode film 10*c* has an increased rate of reaction compared to the lower part of the gate electrode film 10*c* of FIG. 1E because there is no first reaction control film under the gate electrode film 10*c*.

Figure 7A:
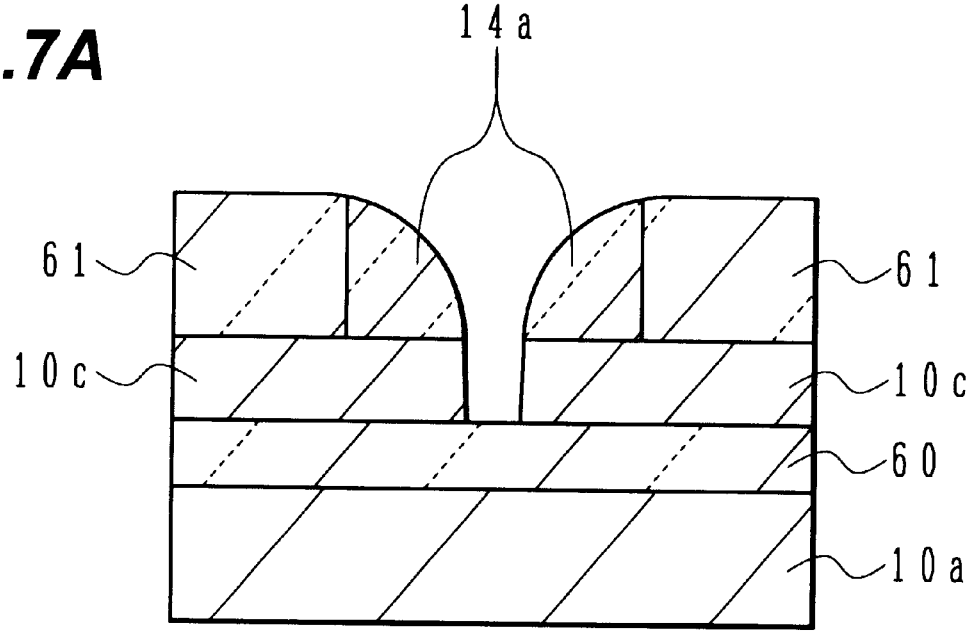
FIGS. 7A and 7B show a manufacturing process of a field emission element according to a sixth embodiment.
Figure 7B:
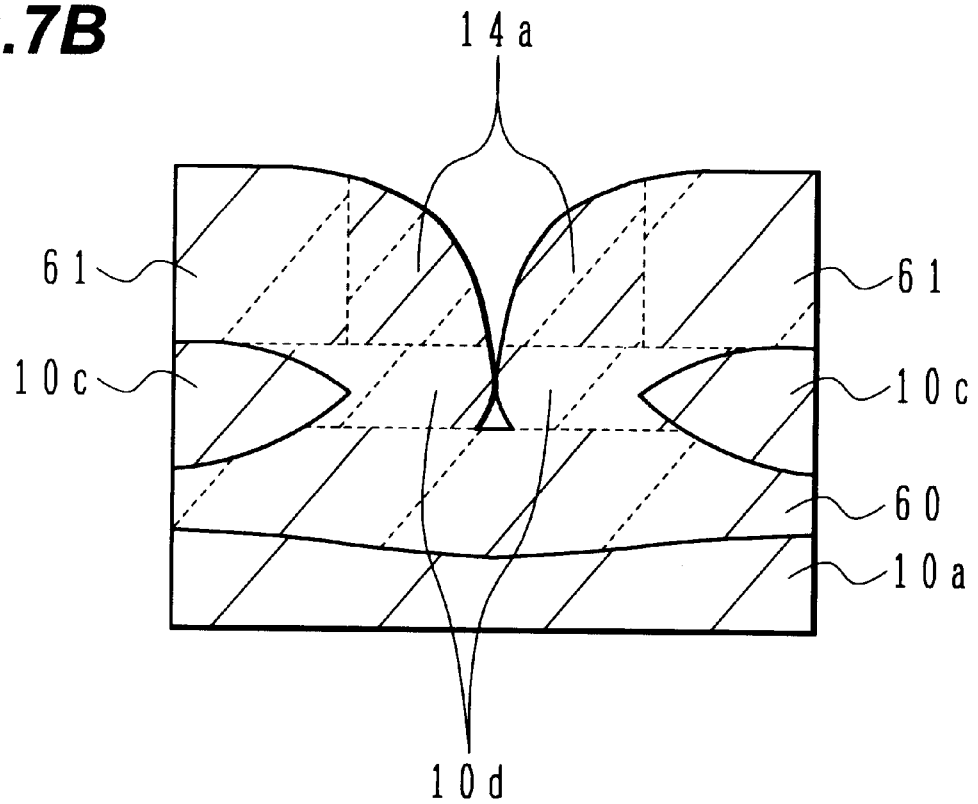

FIGS. 7A and 7B show a manufacturing process of a field emission element according to a sixth embodiment. The sixth embodiment shown in FIGS. 7A and 7B basically has the same process shown in FIGS. 1A to 1D. However, as shown in FIG. 7A, a sacrificial film (an insulating film) 60 that does not control chemical reaction is formed on the substrate 10*a* to have a thickness of about 1000 angstroms instead of forming the first reaction inhibitive film 10*b* shown in FIG. 1D. The sacrificial film 50 is made of, for example, $SiO_2$, PSG, BPSG or the like. Further, another sacrificial film (an insulating film) 61 having a thickness of 2500 angstroms is directly formed on the gate electrode 10*c* instead of forming the second reaction inhibitive film 11*a* shown in FIG. 1D. The sacrificial film 61 is made of, for example, $SiO_2$, PSG, BPSG or the like.

Then, as shown in FIG. 7B, oxidation of the gate electrode 10*c* forms a mold for an emitter electrode. The mold is used for forming an emitter electrode. This chemical reaction (oxidation) process and the formation of the emitter electrode is the same as the process and the formation shown in FIGS. 1E to 1G. However, because there are neither a first nor a second reaction inhibitive film on the upper and lower surfaces of the gate electrode 10*c*, the oxidation of the gate electrode film 10*c* progresses faster (and deeper) than that of the first embodiment.

The composite-shaped emitter electrode can be easily manufactured by forming the reaction inhibitive film(s) on and/or below the gate electrode film 10*c*.

In each of the above-described first to sixth embodiments, the gate electrode 10*c* is formed having a gate hole wherein the cross section is a beak-shaped, which means that the center part is projecting further toward the inside than the lower and upper parts.

The tip of emitter electrode 15 is extended near the gate hole. An insulating film formed between the gate electrode 10*c* and the emitter 15 electrically insulates the gate electrode 10*c* and the emitter 15.

Selecting a manufacturing method from the above-described embodiments and/or adjusting reaction conditions properly can make it possible to obtain a composite-shaped emitter electrode in desired shape and size.

Although the embodiments are described in connection with a two-electrode element, similar concepts can be applied to a field emission element in a three-electrode element that has an anode electrode in addition.

Figure 8:
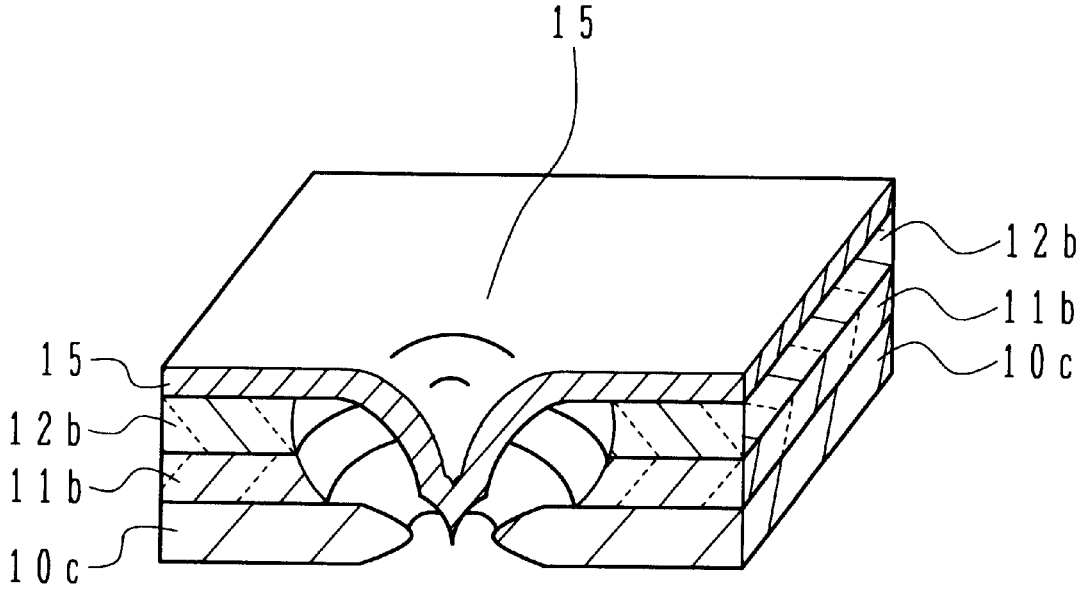
FIG. 8 is a perspective view of a two-electrode element according to the first embodiment shown in FIG. 1G.

FIG. 8 is a perspective view of the two-electrode element according to the first embodiment shown in FIG. 1G. The tip of the emitter electrode 15 is configured inside the gate hole made by the gate electrode 10*c* and fined like a pin.

Figure 9:
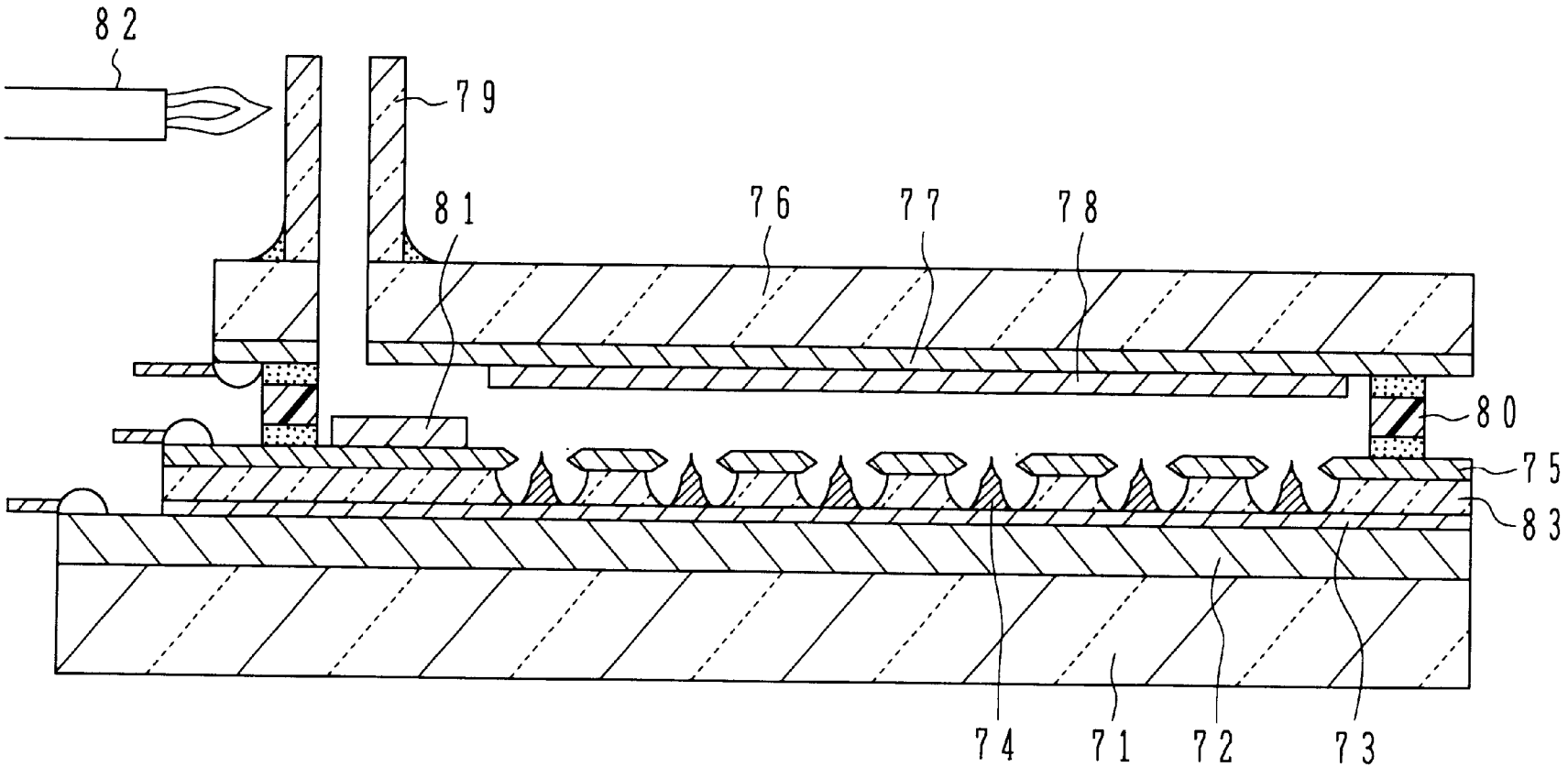
FIG. 9 is a cross sectional view of a flat panel display using field emission elements according to an embodiment.
Figure 10A:
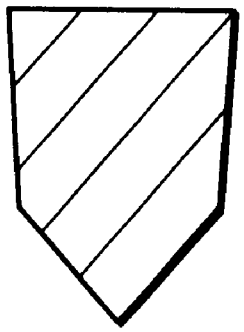
FIGS. 10A and 10B is cross sectional views of emitter electrodes of field emission elements.
Figure 10B:
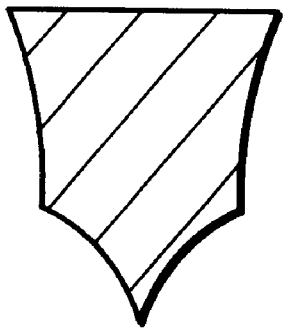

FIG. 9 is a cross sectional view of a flat panel display using field emission elements according to an embodiment. The field emission elements are the two-electrode elements that are, for example, formed by the method according to the first embodiment.

On a supporting substrate 71 made of an insulator are formed a circuit layer 72 made of Al, Cu or the like and a resistance layer 73 made of poly-crystalline silicon or the like. An insulating layer 83 is formed on the resistance layer 73. A plurality of gate electrodes 75 having openings (gate holes) are formed on the insulating layer 83 and a plurality of emitter electrodes 74 whose tips are configured within the gate holes are arranged on the resistance layer 73 to form a field emitter array (FEA). Voltage can be applied to each gate electrode 75 independently though it is not shown in the drawing. Voltage also can be applied to each of the plurality of emitter electrodes 74 independently.

A facing substrate made of glass, quartz or the like is configured to face toward an electron source having the gate electrodes 75 and the emitter electrodes 74. The facing substrate comprises a transparent substrate 76, a transparent electrode (an anode electrode) 77 made of ITO or the like and configured on the underside of the transparent substrate 76 and a fluorescent substance 78 configured on the underside of the transparent electrode 77.

The electron source and the facing substrate are joined via a spacer 80 made of a glass substrate coated with an adhesive, keeping a distance between the substrates at about 0.1 to 5 mm. Low-melting-point glass may be used as the adhesive.

Further, scattering glass beads or the likes into an adhesive made of epoxy resin or the like may form the spacer 80.

A getter 81, for example made of Ti, Al, Mg or the like, prevents out gas from re-adhering to the emitter electrodes 74.

An evacuation nozzle 79 is formed in the facing substrate in advance. Inside of the flat panel display is evacuated to $10^{-5}$ to $10^{-9}$ Torr by using a vacuum system and the evacuation nozzle 79. After that, a burner 82 or the like seals the evacuation nozzle 79. Then, the anode electrode 77, the emitter electrodes 74 and the gate electrodes 75 are wired to complete the flat panel display.

The anode electrode 77 is always kept at positive potential. An emitter circuit and a gate circuit select a displaying pixel two-dimensionally. That is, a field emission element configured at a crossing point of the impressed emitter and gate circuits is selected.

Negative potential and positive potential are applied to the emitter electrodes and the gate electrodes respectively, and electrons are emitted form the emitter electrodes toward the gate electrodes. When the electrons irradiate the fluorescent substance 78, that part (a pixel) will emit light.

The present invention has been described in connection with the preferred embodiments. The invention is not limited only to the above embodiments. It will be apparent to those skilled in the art that various modifications, improvements, combinations and the like can be made.

What are claimed are:

1. A method of manufacturing a field emission element comprising the steps of:

(a) forming, on a substrate, a base layer comprising a gate film formed of a conductive material which is capable of chemical reaction accompanying volume expansion;

(b) forming an insulating film on said base layer;

(c) forming a taper-shaped first hole in said insulating film;

(d) forming a second hole in said gate film by anisotropically etching said gate film using said insulating film as a mask;

(e) reacting a part of a surface layer of said gate film to form a volume-expanded film by chemical reaction;

(f) forming an emitter film made of an electrically conductive material on said insulating film and said expanded film; and (g) exposing said emitter film and said gate film by removing unnecessary parts comprising said substrate and said expanded film.

2. A method of manufacturing a field emission element according to claim 1, wherein said base layer comprises one or two reaction inhibitive film or films formed on both or either of an upper surface and an undersurface of said gate film for inhibiting said chemical reaction.

3. A method of manufacturing a field emission element according to claim 1, wherein an insulating film or films, not inhibiting said chemical reaction, is or are formed both or either of on and under said gate film.

4. A method of manufacturing a field emission element according to claim 1, wherein said step (c) is one of steps:

(c-1) forming said taper-shaped first hole by forming a first hole in said insulating film and forming a side spacer on a sidewall of the first hole;

(c-2) forming said taper-shaped first hole by forming a first hole in said insulating film and reflowing the insulating film by heating; or (c-3) forming said taper-shaped first hole by forming a first hole in said insulating film and etching a corner of the first hole.

5. A method of manufacturing a field emission element according to claim 1, wherein said gate film is made of poly-crystalline silicon.

6. A method of manufacturing a field emission element according to claim 5, wherein said base layer comprises one or two reaction inhibitive film or films made of $SiN_x$ and formed on both or either of an upper surface and an undersurface of said gate film for inhibiting said chemical reaction.

7. A method of manufacturing a field emission element according to claim 5, wherein the insulating film includes a film or films made of one of $SiO_2$, PSG and BPSG, and formed both or either of on and under said gate film.

8. A method of manufacturing a field emission element according to claim 5, wherein said step (e) is a step of forming an expanded film by oxidizing said gate film.

9. A method of manufacturing a field emission element according to claim 1, further comprising, after said step (g), a step of ion milling a tip of the emitter film to obtain a further fine tip.

10. A method of manufacturing a field emission element according to claim 1, wherein said step (g) further comprises a step of forming a gate electrode overhanging toward a center of a gate hole.

11. A method of manufacturing a field emission element comprising the steps of:

(a) forming a first insulating film on a substrate comprising an anode film made of conductive material;

(b) forming a base layer comprising a gate film made of an electrically conductive film being capable of chemical reaction accompanying volume expansion, on said first insulating film;

(c) forming a second insulating film on said base layer;

(d) forming a taper-shaped first hole in said second insulating film;

(e) forming a second hole in said gate film by anisotropically etching said gate film using said second insulating film as a mask;

(f) reacting a part of said gate film to form a volume-expanded film by chemical reaction;

(g) forming an emitter film made of an electrically conductive material on said second insulating film and said expanded film; and (h) exposing said emitter film, said gate film and said anode film by removing a part of said first insulating film and unnecessary parts comprising said expanded film.

* * * * *